US009057121B2

(12) United States Patent
Kosaka et al.

(10) Patent No.: US 9,057,121 B2
(45) Date of Patent: Jun. 16, 2015

(54) METHODS FOR THE MANUFACTURE OF A TITANIUM ALLOY FOR USE IN COMBUSTION ENGINE EXHAUST SYSTEMS

(75) Inventors: Yoji Kosaka, Henderson, NV (US); Stephen P. Fox, Henderson, NV (US)

(73) Assignee: Titanium Metals Corporation, Denver, CO (US)

( * ) Notice: Subject to any disclaimer, the term of this patent is extended or adjusted under 35 U.S.C. 154(b) by 383 days.

(21) Appl. No.: 12/614,203

(22) Filed: Nov. 6, 2009

(65) Prior Publication Data

US 2010/0108208 A1 May 6, 2010

Related U.S. Application Data

(60) Provisional application No. 61/112,083, filed on Nov. 6, 2008.

(51) Int. Cl.

| | |
|---|---|
| ***C22F 1/18*** | (2006.01) |
| ***C22C 14/00*** | (2006.01) |
| *F01N 13/16* | (2010.01) |

(52) U.S. Cl.

CPC . *C22C 14/00* (2013.01); *C22F 1/18* (2013.01); *F01N 13/16* (2013.01)

(58) Field of Classification Search

USPC ..... 148/670, 671

See application file for complete search history.

(56) References Cited

U.S. PATENT DOCUMENTS

| | | | | |
|---|---|---|---|---|
| 4,600,449 | A | 7/1986 | White et al. | |
| 4,738,822 | A | 4/1988 | Banis | |
| 4,765,169 | A * | 8/1988 | Bradlee | 72/160 |
| 4,871,400 | A | 10/1989 | Shindo et al. | |
| 5,358,586 | A | 10/1994 | Schutz et al. | |
| 5,885,375 | A | 3/1999 | Takemura et al. | |
| 6,531,091 | B2 | 3/2003 | Miyamoto et al. | |
| 7,767,040 | B2 | 8/2010 | Kosaka et al. | |

(Continued)

FOREIGN PATENT DOCUMENTS

| | | |
|---|---|---|
| JP | 10017961 | 1/1998 |
| JP | 10146456 | 12/1999 |

(Continued)

OTHER PUBLICATIONS

International Search Report issued in related International Application No. PCT/US09/63608 mailed on Jan. 12, 2010.

Written Opinion of the International Searching Authority issued in related International Application No. PCT/US09/63608 mailed on Jan. 12, 2010.

(Continued)

*Primary Examiner* — Rebecca Lee

(74) *Attorney, Agent, or Firm* — Brinks Gilson & Lione

(57) ABSTRACT

Methods for the manufacture of the above-mentioned titanium alloy for use in combustion engine exhaust systems are disclosed herein. An exemplary method of the disclosed subject matter for the manufacture of titanium alloy for use in a high temperature and high stress environment includes performing a first heat treatment of the titanium alloy at a first temperature, rolling the titanium alloy to a desired thickness, performing a second heat treatment of the titanium alloy at a second temperature, and performing a third heat treatment of the titanium alloy at a third temperature. In some embodiments, the first temperature is selected such that recrystallization and softening of the titanium alloy is optimized without substantial coarsening of second phase particles and can be approximately 1500-1600° F. In some embodiments, the rolling of the titanium alloy reduces the thickness of the titanium alloy by at least than 65%.

20 Claims, 6 Drawing Sheets

(56) References Cited

U.S. PATENT DOCUMENTS

| | | | | |
|---|---|---|---|---|
| 2001/0050117 | A1 | 12/2001 | Oyama et al. | |
| 2004/0094241 | A1 * | 5/2004 | Kosaka et al. | 148/421 |
| 2005/0202271 | A1 | 9/2005 | Yashiki et al. | |

FOREIGN PATENT DOCUMENTS

| | | |
|---|---|---|
| JP | 11267954 | 4/2001 |
| JP | 2003055725 | 2/2003 |
| WO | WO9737049 | 10/1997 |

OTHER PUBLICATIONS

"ASM Handbook: vol. 2 Properties and Selection: Nonferrous Alloys and Special-Purpose Materials", ASM International, 1990, pp. 592-594, 608-610.

A.M. Siierman, C.J. Sommer, & F.II. Froes, Ford Motor Co., Res Lab. "The Use of Titanium in Production Automobiles: Potential and Challenges", *JOM Journal of the Minerals Metals & Materials Society*, 1997, vol. 49(5), pp. 38-41.

A.M. Chaze, G. Beranger, & C. Coddet. "A Comparison of the influence of Si, Al, and Cr additions on the high temperature oxidation behaviour of titanium" *Titanium and Science Technology*, 1984, vol. 4, pp. 2665-2672.

R. Boyer, G. Welsch, E.W. Coltings. "Materials Properties Handbook: Titanium Alloys", 1994, pp. 166-173.

R. Boyer, G. Welsch, E.W. Coltings. "Materials Properties Handbook: Titanium Alloys", 1994, pp. 283, 373, 414, 443, 599, 601.

Anoshkin N.F., Titanium alloys, "Titanium alloy semi-products," Moscow, Metallurgy, 1979, p. 418, par. 5 to p. 419, 1st and 4th par., p. 417, 1st par.

Anoshkin N.F., Titanium alloys, Metallography of titanium alloys, Moscow, Metallurgy, 1980, p. 275.

* cited by examiner

METHODS FOR THE MANUFACTURE OF A TITANIUM ALLOY FOR USE IN COMBUSTION ENGINE EXHAUST SYSTEMS

CROSS-REFERENCE TO RELATED APPLICATION

The current application priority under 35 U.S.C. §119(e) to U.S. Provisional Application No. 61/112,083 filed Nov. 6, 2008.

BACKGROUND

1. Field of the Invention

The invention relates to techniques for the manufacture of an oxidation resistant, high strength titanium alloy which may be in the form of a flat rolled or coiled strip product. The techniques are advantageously used for the manufacture of an alloy product ideal for use in automotive exhaust systems components, wherein elevated temperature strength and oxidation resistance are a required combination of properties.

2. Background of the Invention

It is known to use commercially pure (CP) titanium for automotive exhaust systems and mufflers for motorcycles. These exhaust systems made of CP titanium are lighter than those made from standard stainless steel. Weight reductions when using titanium to replace stainless steel may be as high as 44%, which can be equivalent to or larger than approximately 20 lbs. of weight reduction for the system.

The use of CP titanium in exhaust systems, while providing the benefit of good weight reduction, on the other hand results in the CP titanium exhibiting excessive oxidation and softening due to the high temperatures associated with this application. Consequently, the use of CP titanium sheet product has been limited to specific components of exhaust systems that are exposed to relatively low temperatures.

Where exhaust pipes are made from titanium they generally include a welded tube manufactured from CP titanium. In the case of muffler and catalytic converter boxes, the components can be manufactured from sheets of CP titanium by forming and welding. The input material for tube and muffler components has typically been produced as a continuous cold rolled strip product. The known process to produce a titanium strip product includes melting an ingot, converting the ingot to an intermediate slab by hot forging or rolling, then rolling the slab from a high temperature to coil sheet product or hot band coil through a series of reducing roll gaps. This can be accomplished through a sequence of rolling mills assembled in tandem or in a reversing mill, as is well known in the art.

The hot band coil is also typically heat treated or annealed in a continuous line furnace and further can be trimmed and treated to remove surface contamination and cracks. The hot band coil is then cold rolled to final gage on a coil rolling mill such as a Sendzimir mill. After rolling the coil can be annealed in a continuous inert gas or vacuum line furnace or in a bell furnace under vacuum or inert gas and finally the cold rolled coil or strip is finished for sale with additional steps that can include leveling, and acid pickling.

In the manufacture of welded tubes for the pipe components of an exhaust system, the cold rolled strip can be slit into appropriate widths and either fed into a continuous tube welding line with roll formers and an autogenous welding source such as tungsten inert gas (TIG), metal inert gas (MIG) or laser welding, or cut to length formed to tube and welded as individual lengths. For these processes, the preferred characteristics for the strip product are a smooth low friction surface to prevent the forming tools from sticking on the strip, a smooth yield curve in the transverse direction to facilitate uniform forming into the tube shape and sufficient bend ductility to form the tube. The welded tube should also have sufficient formability to be bent into the final desired exhaust pipe shapes and have sufficient mechanical (e.g., strength) and oxidation performance characteristics to withstand exposure to the exhaust gas for the intended life of the pipe components.

For the manufacture of muffler components and catalytic converter boxes, the coil or strip will typically be cut into flat sheets from which individual blanks can be cut before forming and assembly which can involve combinations of deep drawing, pressing, bending, forming and rolling lock seams and welding as necessary. For the manufacture of the muffler components, the key characteristics are formability in drawing and pressing, and excellent bend ductility. The selected material should have sufficient mechanical (e.g., strength) and oxidation performance characteristics to withstand exposure to the exhaust gas for the intended life of the muffler components.

The combination of performance characteristics required for the above-mentioned products is not straight forward. The ideal selection of titanium alloy from a manufacturing standpoint would be a soft commercially pure grade of titanium such as ASTM grade 1 or ASTM grade 2. However, such alloys have limited oxidation life and insufficient high temperature mechanical performance for the current vehicles. Moreover, the next generation of fuel efficient engines is likely to develop even higher temperatures and loads.

Techniques for the production of alloys with improved mechanical and oxidation performance are thus required to meet the needs of the industry for a titanium alloy that can be used at higher temperatures than CP titanium sheet product. The important properties for this product are oxidation resistance and elevated temperature strength at temperatures up to 1600° F. In addition, since this sheet product requires a forming and fabricating operation to produce the various exhaust system components, cold formability and weldability are required to be near the properties exhibited by CP titanium.

SUMMARY OF THE INVENTION

Methods for the manufacture of the above-mentioned titanium alloy for use in combustion engine exhaust systems are disclosed herein.

An exemplary method of the disclosed subject matter for the manufacture of titanium alloy for use in a high temperature and high stress environment includes performing a first heat treatment of the titanium alloy at a first temperature, rolling the titanium alloy to a desired thickness, performing a second heat treatment of the titanium alloy at a second temperature, and performing a third heat treatment of the titanium alloy at a third temperature. In some embodiments, the first temperature is selected such that recrystallization and softening of the titanium alloy is optimized without substantial coarsening of second phase particles and can be approximately 1500-1600° F. In some embodiments, the rolling of the titanium alloy reduces the thickness of the titanium alloy by at least than 65%.

In some embodiments, the second temperature is selected to optimize the precipitation of second phase particles and can be approximately 900-1100° F. The third temperature is selected to achieve recrystallization of the titanium alloy without dissolving precipitate particles and in some embodiments can be approximately 1200-1600° F. Any of the first, second or third heat treatments can be performed in an air atmosphere. Alternatively, any of the first, second or third heat treatments can be performed in an inert gas atmosphere.

In some embodiments, the method for the manufacture of titanium alloy for use in a high temperature and high stress environment further includes imparting a controlled strain unto the titanium alloy. In some embodiments, the imparting of a controlled strain unto the titanium alloy involves temper rolling of the titanium alloy and in other embodiments it can involve tension leveling of the alloy.

Another exemplary method for manufacture of titanium alloy for use in a high temperature and high stress environment involves performing a first heat treatment of the titanium alloy at a first temperature, rolling the titanium alloy to a desired thickness, performing a second heat treatment of the titanium alloy at the first temperature for a first time, and performing a third heat treatment of the titanium alloy at a second temperature. In some embodiments, the first time is selected such that a grain size between that of ASTM 3 and ASTM 6 grade titanium alloys is achieved during the second heat treatment. The first temperature is selected such that recrystallization and softening of the titanium alloy is optimized without substantial coarsening of second phase particles and can be approximately 1500-1600° F. The first time can be from approximately 5 minutes to 1 hour. The second temperature is selected to optimize the precipitation of second phase particles and can be approximately 900-1100° F.

The accompanying drawings, which are incorporated and constitute part of this disclosure, illustrate preferred embodiments of the disclosed subject matter and serve to explain the principles of the disclosed subject matter.

Figure 1:
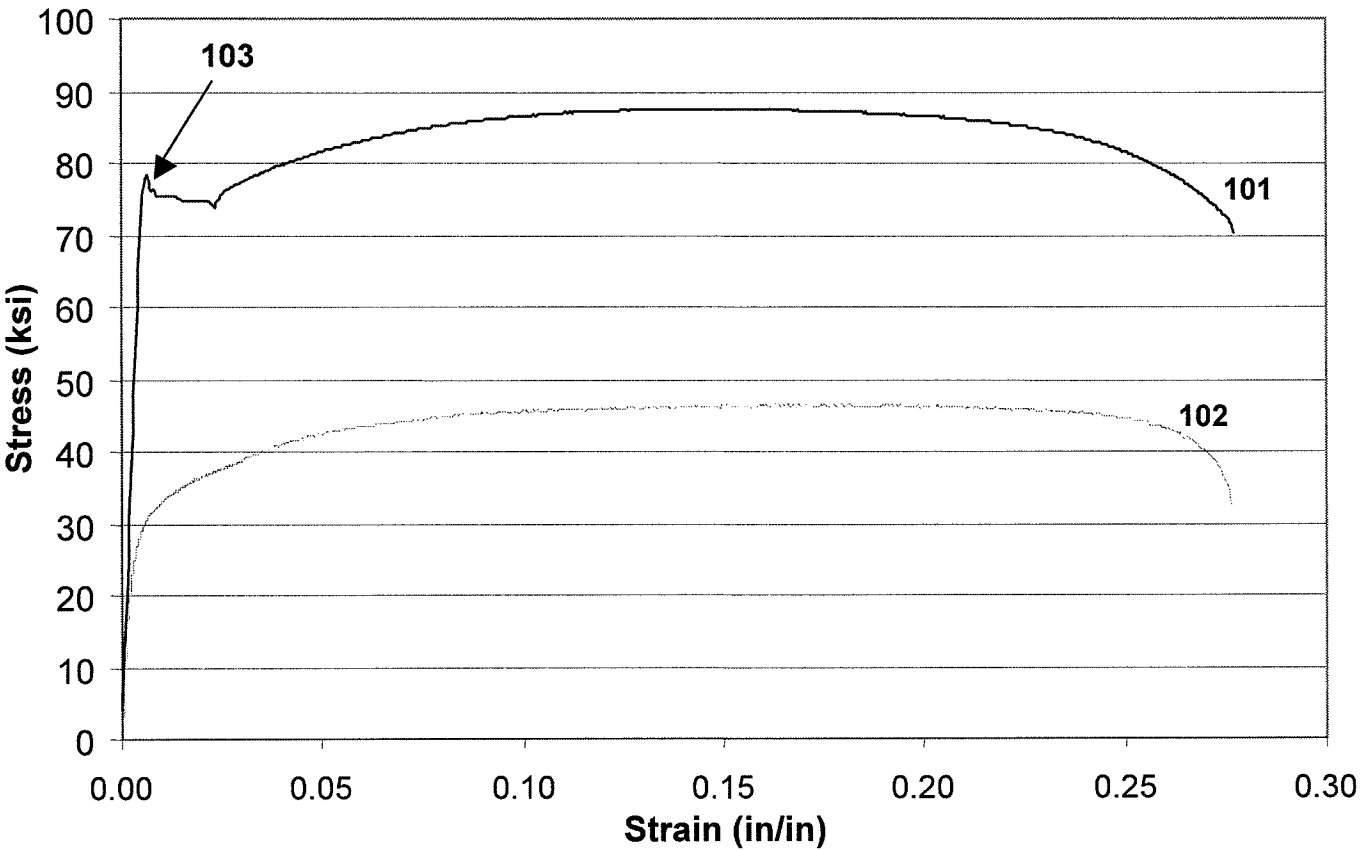
FIG. 1 is a graph showing stress strain curves for commercially pure titanium and an exemplary inventive alloy disclosed herein.

Throughout the drawings, the same reference numerals and characters, unless otherwise stated, are used to denote like features, elements, components or portions of the illustrated embodiments. Moreover, while the disclosed subject matter will now be described in detail with reference to the Figures, it is done so in connection with the illustrative embodiments.

DETAILED DESCRIPTION AND SPECIFIC EXAMPLES

The present disclosed invention provides techniques to produce a high strength titanium alloy having excellent resistance to oxidation after extended exposure to high temperatures and further having excellent ductility at relatively low temperatures. Thus, such techniques produce alloys ideal for use in an automotive or other combustion engine exhaust system where prolonged exposure to high temperature gas is expected for extended periods of time. Further the excellent ductility at relatively low temperatures significantly lowers the costs to produce such exhaust system components.

Accordingly, the present disclosed invention provides techniques for the manufacture of a cold rolled strip or sheet product of the above-mentioned titanium alloy, at a low cost, that suitable for use in automotive or other combustion engine exhaust systems. The cold rolled strip or sheet product is particularly well suited for either the manufacture of exhaust pipe components or for more complex parts such as muffler or catalytic converter components. The present disclosed invention also provides a method for finishing the strip, sheet or final exhaust component to limit cosmetic damage to the external visible surfaces of the exhaust system arising from initial oxidation and mechanical damage during final manufacturing and installation.

Thus, the disclosed invention provides solutions to problems created by the conflicting demands between the operation of an exhaust system in practice and the manufacturing constraints due to the current surface condition, grain size and yield behavior exhibited by alloys suitable for automotive and other combustion engine exhaust systems.

As described further below, these alloys, which may be described as exhaust grade alloys and have the preferred composition of 0.2-0.5% Fe, 0.15-0.6% Si, 0.02-0.12% O, with balance Ti (known as Ti-XT), demonstrate improved mechanical and oxidation performance. In one exemplary embodiment, another preferred composition of Ti-XT can be 0.3-0.5% Fe, 0.35~0.45% Si, 0.06~0.12% O, balance Ti. These exhaust grade alloys can be further improved with small controlled additions of Al, Nb, Cu and Ni separately or in combination for greater strength and oxidation performance. Preferably such controlled additions are in the ranges of 0-1.5% Al, 0-1% Nb, 0-0.5% Cu and 0-0.5% Ni, with the total content of such additions 1.5% or less.

The above described alloys do, however, have some limitations in formability. These limitations are at least partly due to the overall strength and ductility combinations of these alloys, partly due to the yield behavior of these alloys, where a sharp yield point and distinct yield drop are observed, and partly to a grain size that is neither optimized for deformation by twinning or for deformation by slip. Such characteristics can be caused by the controlled additions of certain elements, e.g., iron and silicon, to these alloys that lead to the formation of precipitates of phases of various types in sufficient quantities that affect the normal characteristics of recrystallization and grain growth. Small particles of the body centered cubic form of titanium, commonly known as beta phase, form in most commercially pure grades of titanium. Additional phases, defined herein as precipitates to distinguish them from the particles of beta phase, are typically compounds of titanium with an elemental addition such as Fe, Ni, Si, Cu (e.g., $Ti_2Fe$, $Ti_3Si$, $Ti_5Si_3$).

FIG. 1 illustrates a stress strain curve 101 for a Si containing exhaust grade titanium with a strength between 75 ksi and 100 ksi and a similar curve 102 for a typical soft CP grade titanium optimized for pressing applications. The type of stress strain behavior shown by the exhaust grades is considered undesirable for forming because the sharp yield point and subsequent yield drop 103 results in non-uniform deformation leading to cracking or inconsistent forming. The yield drop 103 is a function of impurity levels, residual stress, grain size and the presence of second phases.

Particularly, grain size is an important parameter with respect to formability, wherein the preferred grain size depends on the forming methods. For pressing operations involving three dimensional strains, it is generally considered to be desirable to have a larger grain size to promote deformation by a twinning mechanism. Deformation twinning is a simple shear of the lattice that occurs over a uniform volume as opposed to dislocation slip where the shear occurs along lattice planes. The twinning mechanism supplements deformation by dislocation slip allowing the metal to better accommodate the three dimensional strain without cracking. In cases of uniaxial or biaxial strain, a fine grain size can be acceptable since the four independent slip systems can normally accommodate the strain. In exhaust grade alloys, knowledge of the phase equilibrium allows development of heat treatments to adjust and modify grain size and to reduce or eliminate the yield drop to optimize the forming performance. Such methods, combined with classical methods for eliminating yield drops such as temper rolling can result in improved performance.

A cold rolled strip is normally provided in an annealed condition to facilitate forming. For tube forming, the surface is typically rather soft and this leads to galling or scratching of the tube by forming tools, resulting in undesirable cosmetic appearance. But for more complex forming, the product can lack adequate formability leading to high cost and constraints in the design of the system.

Further, although Si containing exhaust grade alloys have good overall oxidation performance, they are subject to a certain amount of oxide scale formation in the hottest parts of the exhaust system. Such formation can potentially impact performance, and in any event, can create unsightly appearance which is undesirable to owners of the vehicles.

Thus, presented below is a novel method for the manufacture of Si containing exhaust grade alloy products, which is particularly well suited to improving the characteristics of the above-described titanium alloys.

Figure 2B:
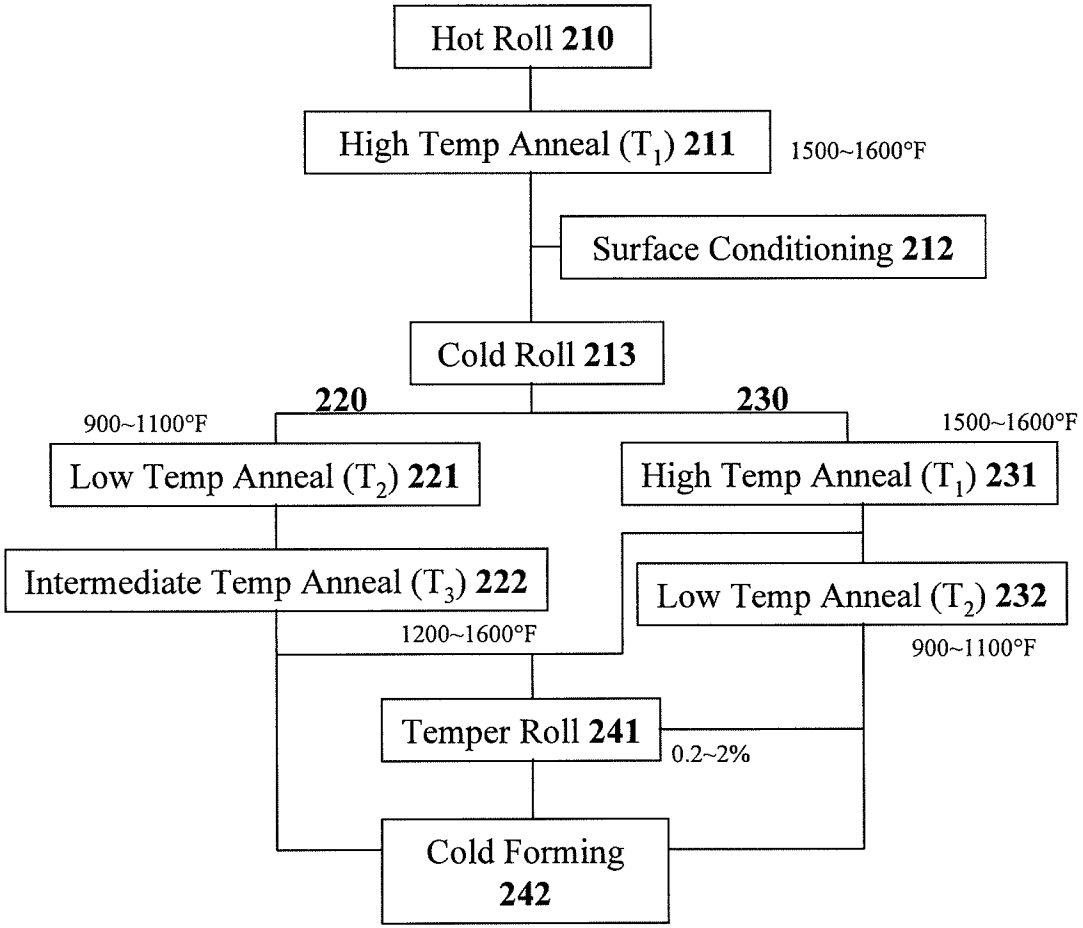
FIG. 2*b* is a diagram illustrating a method in accordance with an exemplary embodiment of the presently disclosed invention.
Figure 2A:
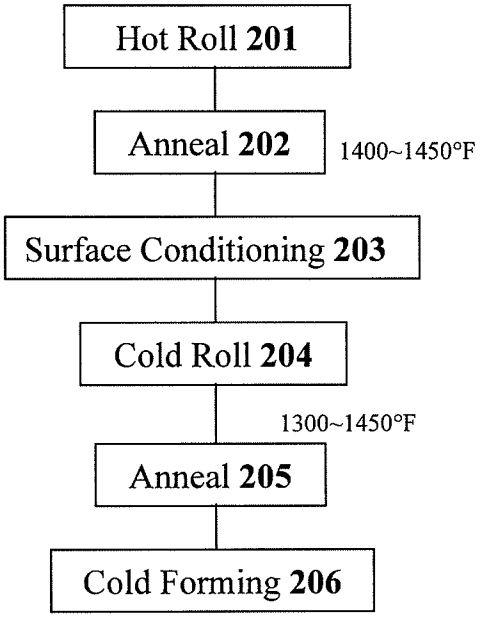
Figure 2a Prior Art
FIG. 2*a* is a diagram illustrating a prior art method for manufacturing titanium.

FIG. 2*a* illustrates a prior art method for the manufacture of titanium alloy for use in combustion engine exhaust systems. As shown in FIG. 2*a*, the prior art process begins with a hot rolling 201 of the titanium alloy, followed by an annealing period 202, which can be performed at approximately 1400-1450° F. for 5 minutes to 1 hour at the target temperature. After the first annealing period 202 the titanium alloy is subject to surface conditioning 203, e.g., blast and pickle or grinding, followed by cold rolling 204, which is nominally performed at room temperature, but in some embodiments can be performed at 250° F. A second annealing 205 is then conducted in inert gas or a vacuum at approximately 1300-1450° F. for 5 minutes to 1 hour at the target temperature. Finally the alloy is cold formed 206 into the final product.

FIG. 2*b* illustrates an exemplary method for the manufacture of titanium alloy for use in combustion engine exhaust systems in accordance with the disclosed invention. As illustrated in FIG. 2*b*, the titanium alloy is first subjected to hot rolling 210, which may be conducted using a hot strip tandem mill or a reversing hot strip mill at a temperature of 1400-1900° F., or preferably at 1600-1800° F., to roll the sheet to a thickness of 0.10-0.30 inches. In an exemplary embodiment, the alloy is then subjected to high temperature annealing 211, at a temperature $T_1$. In one exemplary embodiment, it is desirable to select a heat treatment (annealing) 211 that will optimize the recrystallization and softening without leading to substantial grain coarsening or grain coarsening of second phases such as the $Ti_3Si$ particles. Such treatment can, for example, be conducted at approximately 1500-1600° F., or preferably at 1555-1575° F. and most preferably at 1560° F., and for 5 minutes to 1 hour at $T_1$, or preferably 5 to 15 minutes.

In FIGS. 3*a*-5, HCP represents the alpha phase particles, BCC represents the beta phase particles, $Ti_3Si$ and FeTi represent precipitate phase particles, also known as second phases.

Figures 3A, 3B:
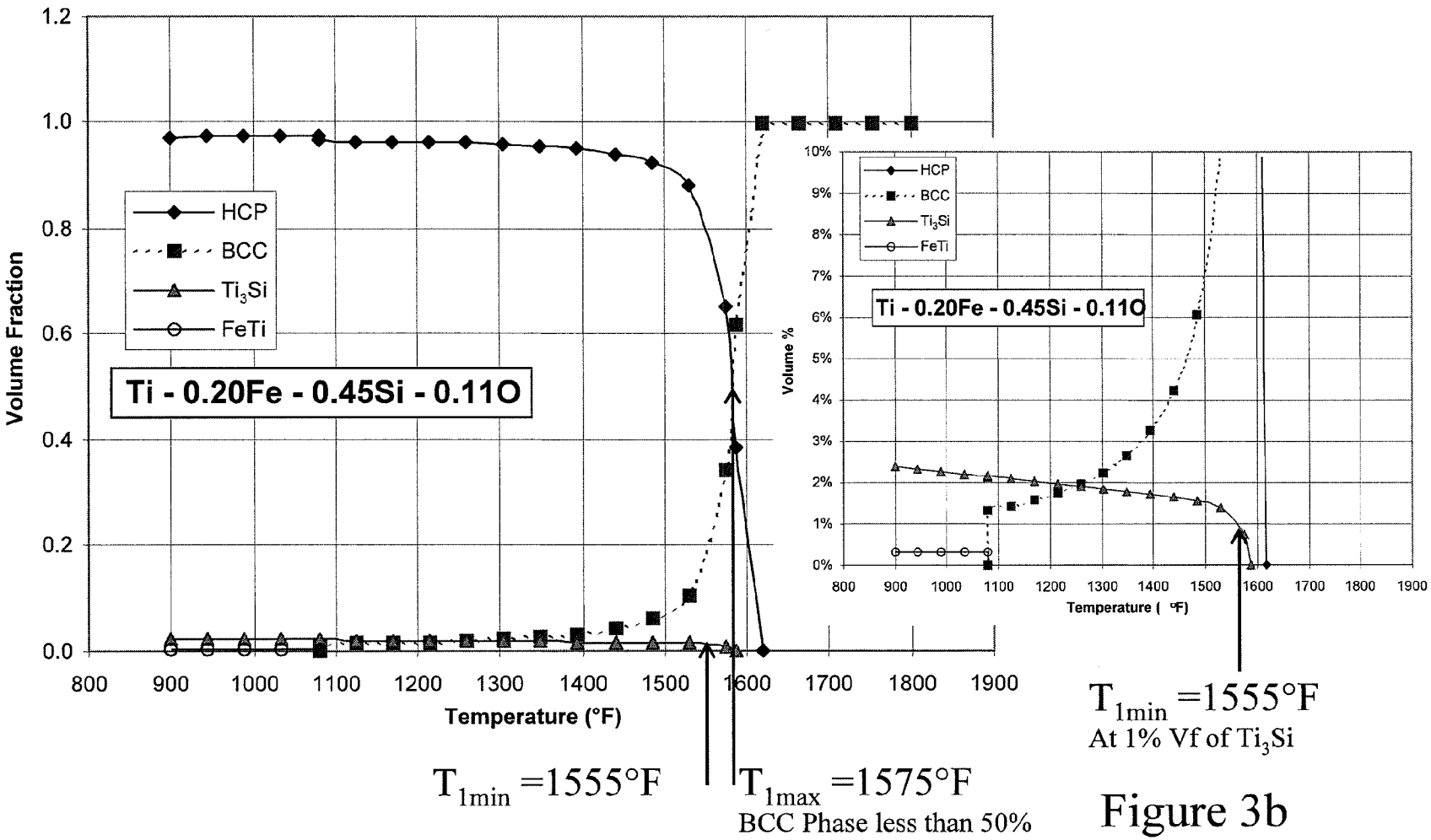
FIG. 3*a* is a graph illustrating the temperature range for $T_1$ and the volume fraction presence of alpha and beta phases and of precipitates in the alloy Ti 0.2% Fe—0.45% Si—0.11% O as a function of temperature in accordance with an exemplary embodiment of the presently disclosed invention.
FIG. 3*b* is a graph illustrating the minimum temperature for $T_1$ and the volume percentage presence of alpha and beta phases and of precipitates in the alloy Ti 0.2% Fe—0.45% Si—0.11% O as a function of temperature in accordance with an exemplary embodiment of the presently disclosed invention.

FIG. 3*a* illustrates an exemplary temperature range of $T_1$, and the phase equilibrium, for a titanium alloy having the composition of 0.2% Fe, 0.45% Si, and 0.11% O (all percentages by weight), balance Ti. The exemplary temperature range of $T_1$ shown in FIG. 3*a* is an exemplary range capable of achieving complete recrystallization without rapid grain growth or coarsening. It is desirable to heat treat above the temperature where the precipitate phase begins to dissolve but below the temperature where the structure is greater than 50% of the beta (BCC) phase. In one exemplary embodiment, as illustrated in FIG. 3*a*, the minimum value for $T_1$, $T_{1min}$, can be 1555° F. As further illustrated in FIG. 3*a*, the exemplary maximum for $T_1$, $T_{1max}$, can be 1575° F. FIG. 3*b* illustrates an expanded view of the graph in FIG. 3*a*, showing that $T_{1min}$ can be defined as the temperature will produce less than a 1% volume fraction (Vf) of precipitate $Ti_3Si$.

Within this temperature range, the driving force for recrystallization is improved but the growth of alpha grains (HCP) is controlled by the presence of the beta phase (BCC) and any residual precipitates. In the same or another embodiment, the heat treatment 211 can optimize the titanium alloy strip for subsequent cold rolling. In the disclosed invention, the first heat treatment (annealing) 211 is followed by cold rolling 213 to a reduction of not less than 65% reduction in gage, and in some embodiments, a 75% reduction in gage. A cooling period (not shown) may be interposed between the heat treatment 211 and the cold rolling 213, in which the alloy strip is cooled to a room temperature or in some embodiments to at least 250° F. As illustrated in FIG. 2*b*, surface conditioning 212, e.g., blast and pickle or grinding, can be interposed between the first heat treatment (annealing) 211 and the cold rolling 213 of the titanium alloy. In addition, the cooling period can be performed before the surface conditioning 212.

As further illustrated in FIG. 2*b*, following cold rolling 213 two heat treatment (annealing) options exist, 220, 230. To improve the product for strength and simple uniaxial forming it is desirable to minimize the grain size. In one exemplary embodiment, this is achieved by a two part heat treatment (annealing) 220. In this embodiment, after cold rolling 213, a heat treatment 221 is performed at a temperature $T_2$, which is selected to optimize the precipitation of second phase particles, e.g., $Ti_3Si$ and/or FeTi. In one exemplary embodiment, the range of $T_2$ is 900-1100° F., and preferably 950-1080° F., and the heat treatment 221 can be performed for 5 minutes to 24 hours. In one exemplary embodiment the preferred time range for performing heat treatment 221 is 1 to 8 hours and in another preferred embodiment the range is 5 to 15 minutes.

Figure 4:
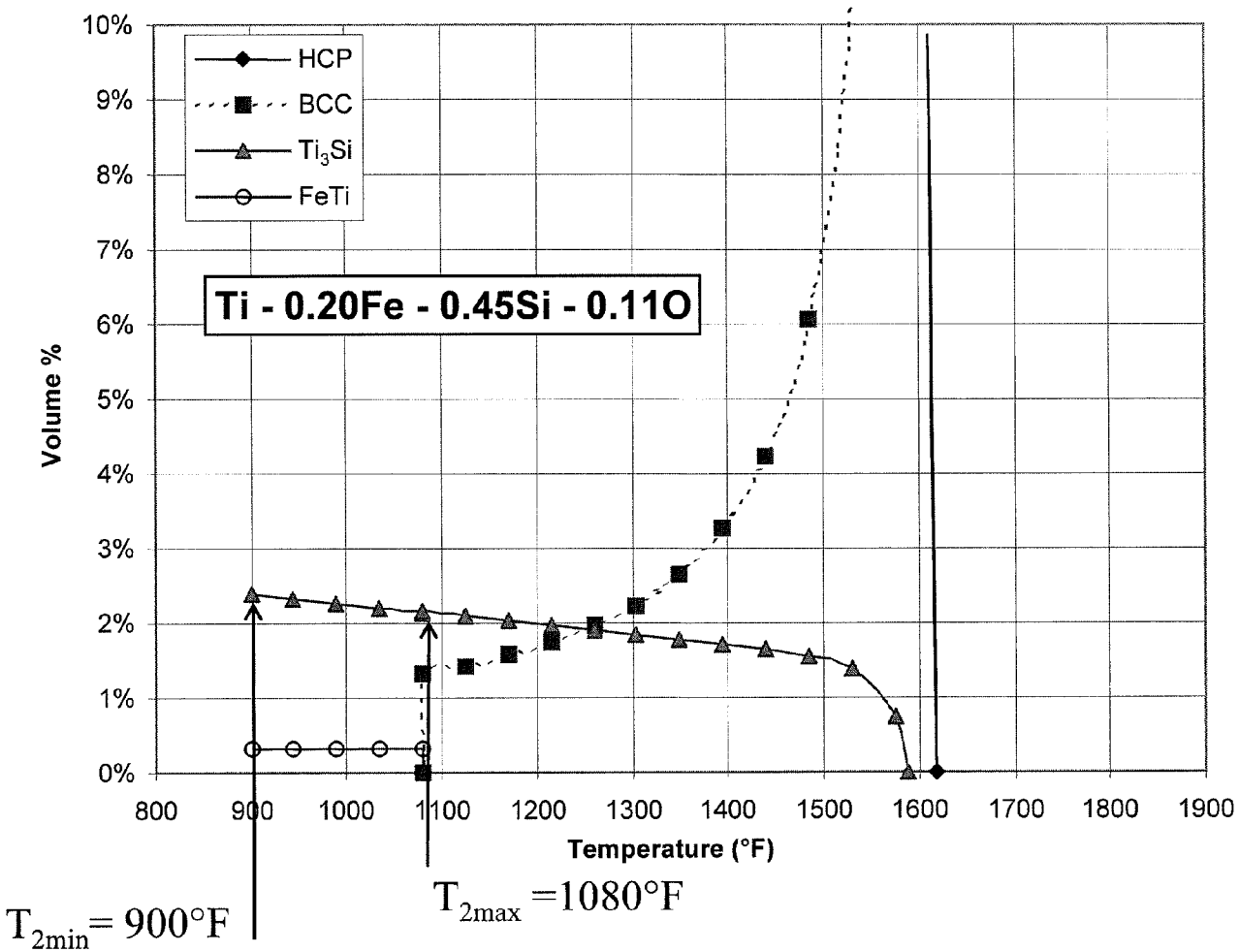
FIG. 4 is a graph illustrating the temperature range for $T_2$ and the volume percentage presence of alpha and beta phases and of precipitates in the alloy Ti 0.2% Fe—0.45% Si—0.11% O as a function of temperature in accordance with an exemplary embodiment of the presently disclosed invention.

FIG. 4 illustrates an exemplary range of $T_2$, and the phase equilibrium, for a titanium alloy having the composition of 0.2% Fe, 0.45% Si, and 0.11% O (all percentages by weight). In one embodiment illustrated in FIG. 4, $T_2$ can be defined as the temperature where the volume fraction (Vf) of precipitates increases, and $T_2$ should also be a sufficiently high temperature so as to allow such precipitation to occur within 24 hours. Thus, in FIG. 4 $T_{2min}$, represents the minimum temperature below which effective precipitation of second phase particles does not occur, e.g., 900° F. As illustrated in FIG. 4, $T_{2max}$ represents the maximum temperature above which precipitation begins to materially decline, e.g., 1080° F.

Returning to FIG. 2*b*, following the heat treatment (annealing) 221 at $T_2$, the titanium alloy strip is then be annealed again 222 at a temperature $T_3$ to recrystallize the product without dissolving the precipitate. In one exemplary embodiment, the range of $T_3$ is 1200-1600° F., preferably 1400-1600° F., and the heat treatment 222 can be performed for 5 minutes to 1 hour at $T_3$, and preferably for 5 to 15 minutes.

Figure 5:
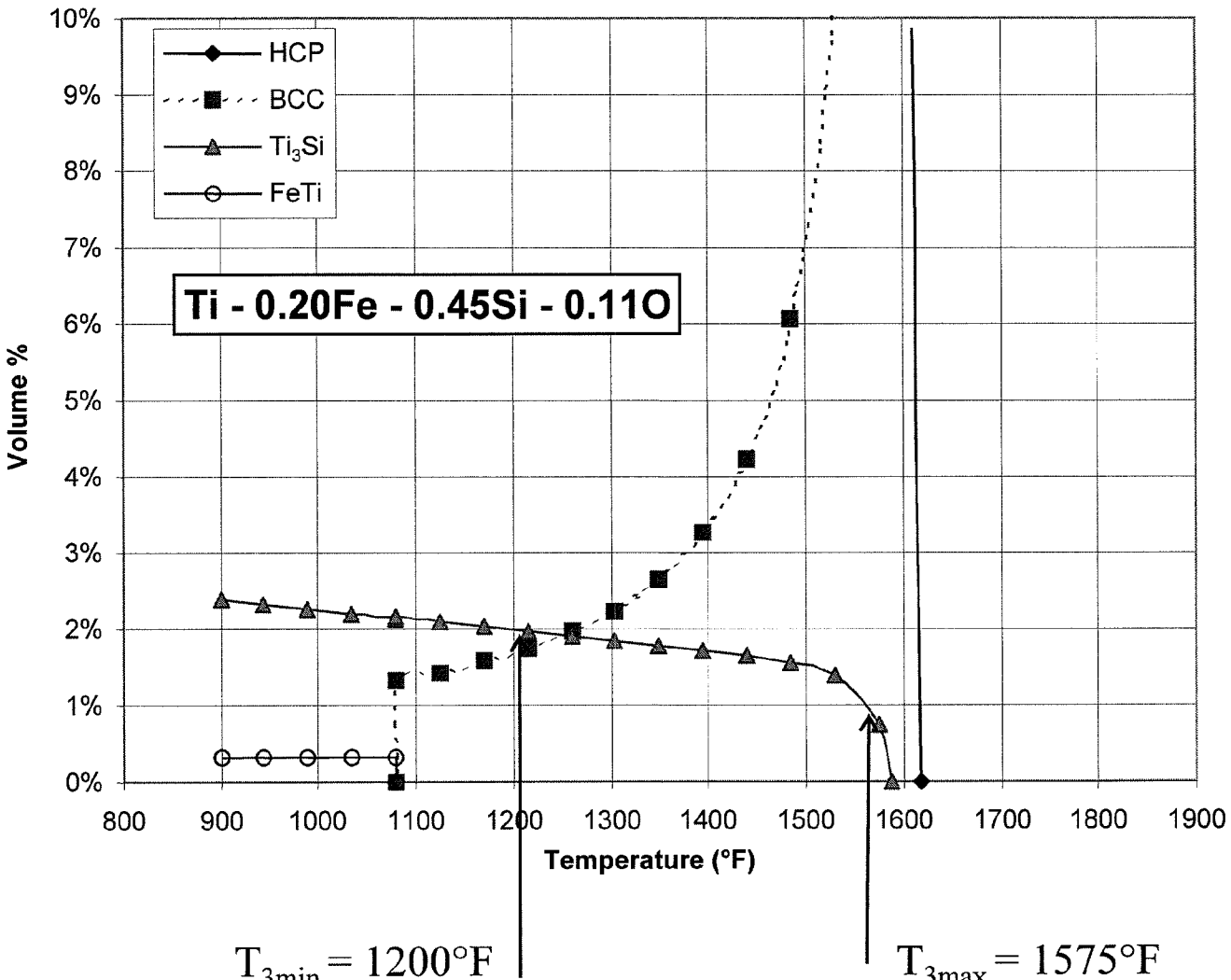
FIG. 5 is a graph illustrating the temperature range for $T_3$ and the volume percentage presence of alpha and beta phases and of precipitates in the alloy Ti 0.2% Fe—0.45% Si—0.11% O as a function of temperature in accordance with an exemplary embodiment of the presently disclosed invention.

FIG. 5 illustrates an exemplary range of $T_3$ for a titanium alloy having the composition of 0.2% Fe, 0.45% Si, and 0.11% O (all percentages by weight), balance Ti. As shown in FIG. 5, the pinning action of the precipitates will result in a fine grain size that is ideal for improving the strength and uniaxial forming behavior. In one embodiment illustrated in FIG. 5, the maximum value of $T_3$, $T_{3max}$, is defined by the temperature where the volume fraction (Vf) of precipitates declines below 1% losing effective grain boundary pinning, e.g., $T_{3max}\approx 1575°$ F. The lower boundary of $T_3$, $T_{3min}$, is defined by the temperature where effective recrystallization becomes unlikely, e.g., $T_{3min}\approx 1200°$ F.

Figure 6:
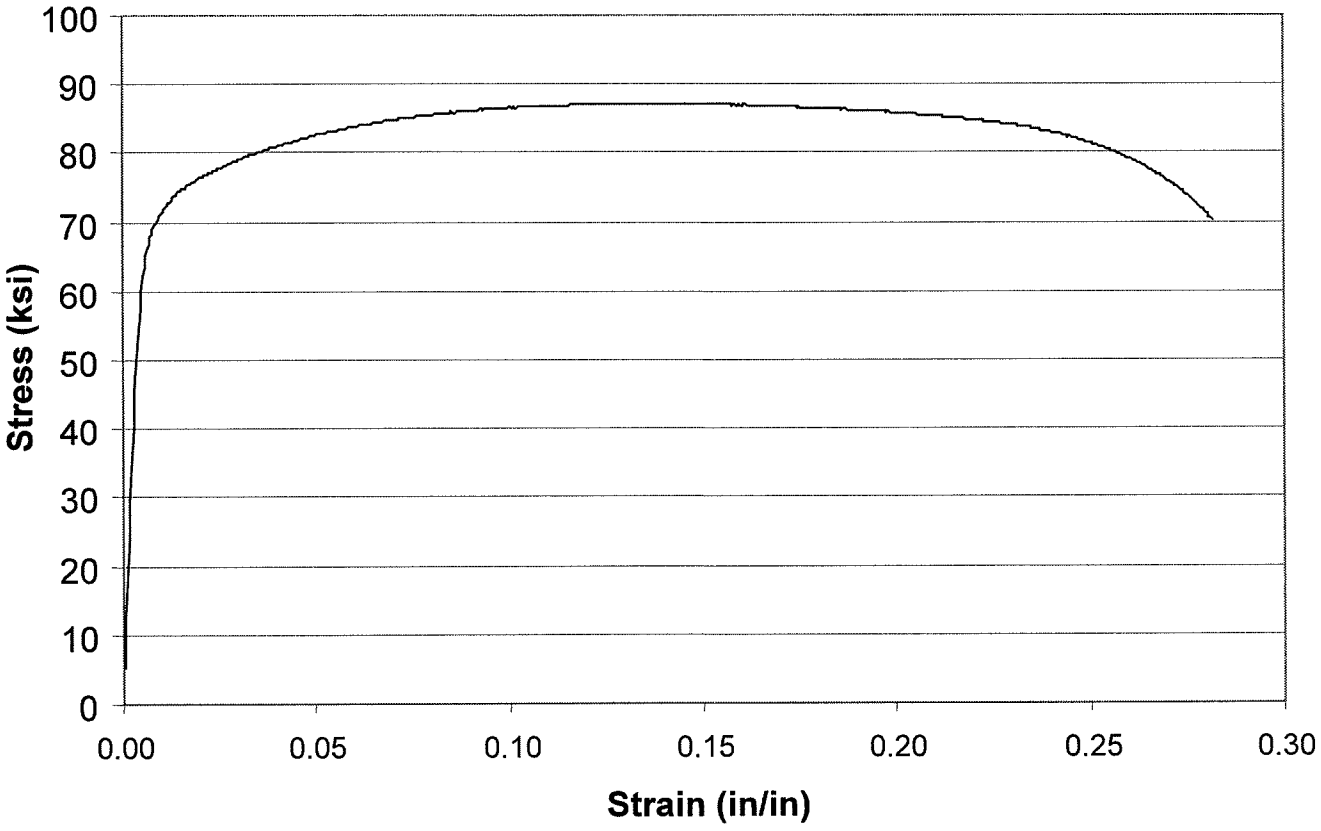
FIG. 6 is a stress strain curve for a Si containing exhaust alloy optimized for subsequent forming applications in accordance with an exemplary embodiment of the presently disclosed invention.

In one embodiment, the heat treatments (annealing), 221, 222, at $T_2$ and $T_3$ can be conducted separately with cooling to room temperature between (not shown). In an alternative embodiment, the heat treatments (annealing), 221, 222, at $T_2$ and $T_3$ can be combined into a single cycle in which following the first treatment 221 at $T_2$ the furnace is heated 222 directly to $T_3$ for the second treatment 222. In the same or another embodiment, an additional component of the technique can be to impart a controlled strain 241, for example, by temper rolling 241 in order to overcome the initial yield point and result in the optimized yield behavior. In some embodiments, imparting the controlled strain 241 can be achieved by tension leveling 241, as is known in the art. Alternatively, imparting a controlled strain 241 can be omitted all together. The percent of strain to be imparted is generally between 0.2% and 2% and, in some embodiments, in the range of 0.5 to 1%. The stress strain curve is of the type shown in FIG. 6, which is the stress strain curve after imparting the controlled strain 241.

In one embodiment, in the second heat treatment option 230 it is desirable to produce a coarsened grain size that promotes twinning deformation. As illustrated in FIG. 2*b*, after cold rolling 213, the titanium alloy strip is once more heat treated 231 at $T_1$ for a time sufficient to achieve a grain size between the grain sizes of ASTM 3 and ASTM 6 grade titanium alloys, e.g., 45-127 microns in diameter. In one exemplary embodiment this time can be 5 minutes to 1 hour at $T_1$. In one embodiment, this processes produces grain sizes that improve deformation by twinning and facilitate deep pressing and complex forming operations. The strip can then annealed 232 at $T_2$ for, e.g., 5 minutes to 24 hours, and preferably for 1 to 8 hours, to precipitate the silicides, e.g., $Ti_3Si$ and/or FeTi, necessary to prevent grain growth during use.

An additional component to the technique can be to impart a controlled strain 241, for example, by temper rolling 241, or tension leveling 241, in order to overcome the initial yield point and result in the optimized yield behavior. As further illustrated in FIG. 2*b*, imparting a controlled strain 241, by for example temper rolling 241, or tension leveling 241, can be performed between the high temperature heat treatment 231 at $T_1$ and the low temperature heat treatment 232 at $T_2$. Alternatively, imparting a controlled strain 241 can be omitted all together. The percent of strain is generally between 0.2% and 2% and, in some embodiments, in the range of 0.5 to 1%. In some embodiments, the stress strain curve is of the type shown in FIG. 6, which is the stress strain curve after imparting the controlled strain 241.

In order to minimize the cost of the heat treatments, for cases where the manufacture of the exhaust components does not require great formability, the heat treatments of the cold rolled strip at $T_1$, $T_2$ and/or $T_3$, 221, 222, 231, 232 can be optionally conducted in an air line anneal furnace for 5 to 15 minutes followed by an optional light abrasive finish such as a polishing with a Scotch Brite® pad to remove discoloration. The advantages of air annealing lie in cost, as a result of avoidance of inert gas costs or vacuum systems operational costs. In addition, the strip will have a slightly hardened surface that will make it more resistant to scratching and galling by the forming tools, thus giving an improved cosmetic finish.

An alternative to air annealing is to use a nitrogen-inert gas atmosphere for the annealing at $T_1$, $T_2$ and/or $T_3$, 221, 222, 231, 232. In this case, the reaction with nitrogen will form a thin layer of titanium nitride in combination with silicon from the base alloy, which can include some kinds of Ti—N—Si compounds. The modified surface layer will act as a hard layer reducing scratching or galling by the forming tools, thus also giving an improved cosmetic finish. In addition, the nitride layer modified with silicon will act to slow the initial reaction with air during service reducing overall weight gain by oxidation and extending service life.

Annealing in nitrogen-inert gas mixtures, e.g., 5~50% nitrogen gas by volume, to reduce the oxidation rate can be conducted on exhaust system components, sub assemblies and finished systems manufactured from a titanium alloy containing silicon. The resultant hard nitride layer modified with silicon will then act to extend the service life by reducing the weight gain by oxidation and improve resistance to mechanical damages, e.g., stone chipping. The temperature, time and gas mixtures can be selected to improve the extent of silicon present in the surface layers depending on the silicon content of the alloy.

The final element of cold forming 242, as illustrated in FIG. 2*b*, is performed to form the processed exhaust grade alloy into a variety of shapes, as needed for various applications, such as exhaust pipes, mufflers, or catalytic converter components.

Other embodiments of the invention will be apparent to those skilled in the art from consideration of the specification and practice of the invention disclosed herein. It is intended that the specification and examples be considered as exemplary only, with a true scope and spirit of the invention being indicated by the following claims.

All percentages are in percent by weight in both the specification and claims.

What is claimed is:

1. A method for manufacture of titanium alloy for use in a high temperature and high stress environment, comprising:

providing a titanium alloy consisting essentially of, in weight %, 0.2 to 0.5 iron, 0.02 to 0.12 oxygen, 0.15 to 0.6 silicon and balance titanium and incidental impurities; followed by performing a first heat treatment of said titanium alloy at a first temperature that is above the temperature where a precipitate phase begins to dissolve and below a temperature where the titanium alloy has a structure that is greater than 50% of a beta phase; followed by cold rolling said titanium alloy to a desired thickness; followed by performing a second heat treatment of said titanium alloy at a second temperature that allows precipitation of second phase particles in the titanium alloy; and followed by performing a third heat treatment of said titanium alloy at a third temperature to recrystallize the titanium alloy without dissolving precipitate particles.

2. The method of claim 1, wherein said first temperature is selected wherein recrystallization and softening of said titanium alloy is optimized without substantial coarsening of second phase particles.

3. The method of claim 1, wherein said first temperature is approximately 1500-1600° F.

4. The method of claim 1, wherein said rolling of said titanium alloy reduces the thickness of said titanium alloy by at least 65%.

5. The method of claim 1, wherein said second temperature is approximately 900-1100° F.

6. The method of claim 1, wherein said third temperature is approximately 1200-1600° F.

7. The method of claim 1, wherein any of said first, second or third heat treatments are performed in an air atmosphere or an inert gas atmosphere.

8. The method of claim 1, further comprising imparting a controlled strain unto said titanium alloy.

9. The method of claim 8, wherein said imparting of a controlled strain unto said titanium alloy involves temper rolling or tension leveling said titanium alloy.

10. A method for manufacture of titanium alloy for use in a high temperature and high stress environment, comprising:

providing a titanium alloy consisting essentially of, in weight %, 0.2 to 0.5 iron, 0.02 to 0.12 oxygen, 0.15 to 0.6 silicon and balance titanium and incidental impurities;

performing a first heat treatment of said titanium alloy at a first temperature that is above the temperature where a precipitate phase begins to dissolve and below a temperature where the titanium alloy has a structure that is greater than 50% of a beta phase; followed by cold rolling said titanium alloy to a desired thickness; followed by performing a second heat treatment of said titanium alloy at said first temperature for a first time wherein a grain size between that of ASTM 3 and ASTM 6grade titanium alloys is achieved; and followed by performing a third heat treatment of said titanium alloy at a second temperature to precipitate silicides to prevent grain growth during use.

11. The method of claim 10, wherein said first temperature is selected wherein recrystallization and softening of said titanium alloy is optimized without substantial coarsening of second phase particles.

12. The method of claim 10, wherein said first temperature is approximately 1500-1600° F.

13. The method of claim 10, wherein said rolling of said titanium alloy reduces the thickness of said titanium alloy by at least than 65%.

14. The method of claim 10, wherein said first time is approximately 5 minutes to 1 hour.

15. The method of claim 10, wherein said second temperature is approximately 900-1100° F.

16. The method of claim 10, wherein any of said first, second or third heat treatments are performed in an air atmosphere or an inert gas atmosphere.

17. The method of claim 10, further comprising imparting a controlled strain unto said titanium alloy.

18. The method of claim 17, wherein said imparting of a controlled strain unto said titanium alloy involves temper rolling or tension leveling said titanium alloy.

19. A method for manufacture of titanium alloy for use in a high temperature and high stress environment, comprising:

performing a first heat treatment of said titanium alloy at a first temperature that is below a temperature where the titanium alloy has a structure that is greater than 50% of a beta phase; followed by cold rolling said titanium alloy to a desired thickness; followed by performing a second heat treatment of said titanium alloy at a second temperature that allows precipitation of second phase particles in the titanium alloy; and followed by performing a third heat treatment of said titanium alloy at a third temperature to recrystallize the titanium alloy without dissolving the precipitate.

20. A method for manufacture of titanium alloy for use in a high temperature and high stress environment, comprising:

performing a first heat treatment of said titanium alloy at a first temperature that is below a temperature where the titanium alloy has a structure that is greater than 50% of a beta phase; followed by cold rolling said titanium alloy to a desired thickness; followed by performing a second heat treatment of said titanium alloy at said first temperature for a first time wherein a grain size between that of ASTM 3 and ASTM 6 grade titanium alloys is achieved; and followed by performing a third heat treatment of said titanium alloy at a second temperature to precipitate silicides to prevent grain growth during use.

* * * * *